US007442115B1

(12) United States Patent
Brenny et al.

(10) Patent No.: US 7,442,115 B1
(45) Date of Patent: Oct. 28, 2008

(54) RAILWAY GRINDER

(75) Inventors: David Brenny, Eagle, WI (US); Jeff Hon, Rochester, WI (US); Karl Rabenhorst, Pleasant Prairie, WI (US)

(73) Assignee: Racine Railroad Products, Inc., Racine, WI (US)

( * ) Notice: Subject to any disclaimer, the term of this patent is extended or adjusted under 35 U.S.C. 154(b) by 347 days.

(21) Appl. No.: 10/438,957

(22) Filed: May 15, 2003

(51) Int. Cl.
*B24B 7/00* (2006.01)
*B24B 23/02* (2006.01)

(52) U.S. Cl. ..... 451/65; 451/49; 451/58; 451/347

(58) Field of Classification Search ..... 451/49, 451/57, 58, 65, 66, 347
See application file for complete search history.

(56) References Cited

U.S. PATENT DOCUMENTS

| | | | | |
|---|---|---|---|---|
| 1,340,991 | A | 5/1920 | Tabor | |
| 1,405,019 | A | 1/1922 | Simard | |
| 1,562,558 | A | 11/1925 | Hobson | |
| 2,118,621 | A | 5/1938 | Perazzoli | |
| 2,324,263 | A | 7/1943 | Lowe | |
| 2,378,512 | A | 6/1945 | Talboys et al. | |
| 3,377,751 | A | 4/1968 | Schnyder | |
| 3,821,840 | A | 7/1974 | Kershaw | |
| 3,882,645 | A * | 5/1975 | Duecker | 451/347 |
| 3,883,323 | A | 5/1975 | Cooley | |
| 3,945,749 | A | 3/1976 | McIlrath | |
| 3,976,239 | A | 8/1976 | Finck | |
| 4,050,196 | A | 9/1977 | Theurer | |
| 4,178,724 | A | 12/1979 | Bruno | |
| 4,347,688 | A | 9/1982 | Scheuchzer et al. | |
| 4,492,059 | A * | 1/1985 | Panetti | 451/347 |
| 4,729,196 | A | 3/1988 | Chaseling | |
| 4,751,794 | A | 6/1988 | Clem | |
| 4,779,384 | A * | 10/1988 | Shoenhair et al. | 451/347 |
| 4,829,723 | A | 5/1989 | Bull et al. | |
| RE32,979 | E | 7/1989 | Panetti | |
| 4,908,993 | A | 3/1990 | Buhler | |
| 4,993,193 | A * | 2/1991 | Panetti | 451/347 |
| 5,359,815 | A * | 11/1994 | Schrunk et al. | 451/347 |
| 5,575,709 | A | 11/1996 | Hertelendi et al. | |
| 5,735,734 | A | 4/1998 | Hertelendi | |
| 5,997,391 | A | 12/1999 | Jaeggi | |
| 6,033,166 | A | 3/2000 | Hampel | |
| 6,123,606 | A * | 9/2000 | Hill et al. | 451/53 |

FOREIGN PATENT DOCUMENTS

GB 2016321 A * 9/1979

* cited by examiner

*Primary Examiner*—Timothy V Eley
(74) *Attorney, Agent, or Firm*—Boyle Fredrickson S.C.

(57) ABSTRACT

A railway grinding system is capable of grinding a frog, another switch, or another railway section of interest in situ over a precisely defined path that is unaffected by the geometry of the railway section to be ground. The system includes a frame providing the reference path and a grinding machine movable along the reference path. The grinding tool preferably has at least four degrees of freedom with respect to the reference frame. Versatility can be further enhanced by permitting one grinding tool, such as a cup grinder configured to grind a generally horizontal surface of the railway, to be replaced with another grinding tool, such as a flange grinder configured to grind a generally vertical surface of the railway. The frog grinder can perform either single-event reconditioning grinding or periodic maintenance grinding.

21 Claims, 9 Drawing Sheets

RAILWAY GRINDER

BACKGROUND OF THE INVENTION

1. Field of the Invention

The invention relates to railway maintenance equipment and, more particularly, relates to a machine capable of grinding a railway section such as a frog or other railway switch in situ. The invention additionally relates to a method of grinding a railway section using such a machine.

2. Discussion of the Related Art

Switches and other railway sections often require grinding as part of periodic maintenance or reconditioning procedures. One such railway section is a "frog." A frog is a portion of a railway turnout or a crossing where the rails intersect to allow the wheel flanges of a rail car to cross the running rail. A typical frog includes, inter alia, a fixed or movable point forming the intersection of the converging rails, and a throat forming the juncture of the diverging rails. The typical frog is formed from a work hardening manganese casting.

The point and adjacent railway sections of a frog wear during use. Eventually, the upper horizontal surfaces and/or side flanges of the frog and the adjacent railway sections must be welded to replace the broken or worn-away frog portions. The welded portions must then be ground to return the frog surfaces to their original profile. Even before the frog wears to the point that welding is required, optimal frog maintenance requires that the horizontal and side flange surfaces be ground to remove deformed metal that could lead to more rapid frog wear or even breakage. Indeed, because frogs are typically made from a work hardening manganese steel casting, proper early maintenance could alleviate or even eliminate the need to weld the frog if the frog were initially oversized and the wheel-contacting surfaces were ground sufficiently frequently in conjunction with the work hardening process so that the frog has its ideal profile at the end of the work hardening process. The frog would thereafter wear only very gradually. Heretofore, no machine was designed to repeatedly grind frogs at this early stage of wear with high precision.

To the contrary, all previously known railway grinding machines exhibited marked drawbacks.

For instance, one common frog grinding technique requires that that the frog be removed from the railway and reconditioned in a separate maintenance facility containing welding equipment and specially designed stationary frog grinding equipment. The frog grinding equipment used by this type of facility sometimes is designed to grind both horizontal and vertical surfaces of the frog along relatively precisely defined paths, thereby obtaining a desired profile on the reconditioned frog. Machines designed to grind frogs in this manner are disclosed, e.g., in U.S. Pat. No. 3,706,856 to Keifer and U.S. Pat. No. 3,821,840 to Kershaw. These machines are effective, but require that the frog be removed from the railway for their operation. This removal requirement adds considerable expense and downtime to the frog reconditioning process. In addition, this off-site grinding technique cannot be used to effect routine maintenance on a frog that does not require complete reconditioning and also does not permit the installation or production of an initially oversized frog and the frequent grinding of that frog during the work hardening process.

Other machines are available for welding frogs in situ, i.e., without removing the frog from the associated railway section. For instance, Harsco and Plasser both have proposed large, self-propelled, track mounted machines that are used as part of a tie-gang to perform rail grinding functions in addition to other functions. A number of different grinding heads are mounted on the undercarriage of the machine and grind different surfaces of railway sections including frogs as the machine is propelled along the railway.

Sensors may be employed on the carriage to control the positioning of the various grinding heads. Machines of this type are disclosed, e.g., in U.S. Pat. Nos. 4,178,724 to Bruno and 4,908,993 to Buhler. These machines are very large and expensive to build and operate. They also lack the versatility required to precisely machine the points and other surfaces of frogs and other railway switches in situ. They are best-suited for rough grinding operations that must be followed up by hand-held grinding tools for ideal frog profiling.

Another rail grinding machine, designed specifically for frog grinding, is produced by Giesmer under the trade name MC3. The Giesmer MC3 grinder includes a workhead mounted on a carriage that rides along the track section of or in close proximity to the frog. The track sections therefore provide a reference path for carriage grinding head movement. This machine is considerably smaller, more maneuverable, and less expensive than the self-propelled machines manufactured by Harsco, Plasser, and others. However, it also has significant drawbacks and disadvantages. For instance, the rail surfaces of and immediately adjacent the frog provide a poor reference path for grinding because those surfaces deform with frog wear to the point of having pronounced low frequency undulations. Using those surfaces as a reference path during grinding produces corresponding undulations in the frog. In addition, the grinding tool of the Giesmer MC3 grinder grinds only the upper surface of the frog and adjacent rail sections using a flat stone grinder. It cannot effectively grind side surfaces of the ground railway section. It is also incapable of grinding a slope on the frog point that directs the end of the point beneath the level of the rails to assure smooth transfer of load from the frog point to the diverging rail.

Other machines designed to grind frogs and/or other railway sections in situ are disclosed in U.S. Pat. Nos. 3,377,751 to Schnyder and 6,033,166 to Hampel. These systems and other known machines share at least some of the problems with the machines discussed above, and all present other problems of their own.

The need therefore has arisen to provide a railway grinding system and/or method that can grind frogs, other switches, and possibly other sections of railways along precisely-defined grinding paths that are unaffected by the geometry of the railway section to be ground.

The need has additionally arisen to provide a railway grinding system and/or method that is sufficiently versatile to grind vertical, horizontal, and inclined surfaces of railway sections while still following a precisely defined path.

The need has a additionally arisen to provide a railway grinding system and/or method that is sufficiently versatile, precise, and unobtrusive to permit rail sections to be frequently ground in situ for the purpose of, e.g., optimizing a work hardening process.

SUMMARY OF THE INVENTION

In accordance with a preferred aspect of the invention, a railway grinding machine is supported not on the rails themselves but on a separate frame that is clamped or otherwise secured to the rails at locations upstream and downstream of the railway section to be ground so as to provide a "clean" reference path for operation of the machine. The machine can grind a railway section either in situ or with the section removed from the railway.

Preferably, the frame comprises first and second longitudinally spaced transverse supports, each of which is configured to be supported on the railway, first and second clamp assemblies, each of which is configured to releasably clamp a respective one of the supports to at least one rail of the railway; and at least one, and more preferably two, longitudinal guide rails that extend between and are supported on the transverse supports and that support the grinder for movement with respect to the guide rail. In a preferred embodiment, the transverse supports comprise beams spaced sufficiently far apart to assure that undulations and other variations in rail section geometry do not affect the positioning of the frame rails. The rail clamp assemblies set the position of the frame relative to the frog or other railway section by adjustably securing the associated end of the frame to one or more rails of the railway. In addition, one or both ends of the guide rails may be mounted on the support beams via vertically adjustable structures that permit the inclination of the guide rails relative to the support beams to be varied, thereby permitting a desired slope to be ground onto the frog point or other ground railway section.

Preferably, the grinding tool is supported on a carriage that is movable long the guide rails. The grinding tool is mounted on the carriage so as to be movable transversely of the carriage and the guide rails and longitudinally with the carriage along the guide rails. It is also preferably movable vertically and rotationally relative to the carriage to further add to the versatility of the machine.

The grinding tool preferably comprises a chuck configured to interchangeably receive at least first and second grinding tools so as to permit the grinding machine to perform two or more distinctly different grinding operations on the same railway section. For instance, the first and second grinding wheel modules may be configured to grind an upper surface and a side surface of the railway section, respectively.

In accordance with another aspect of the invention, a rail switch grinding method is provided using a grinding machine as generally described above. In addition to grinding a reconditioned rail frog or similar railway section, a frog or other work hardening railway section can be ground not just prior to initial use, but also relatively frequently during the initial phase of use to maximize the work hardening aspect of the railway section and, ideally, to permit the railway section to be fully work hardened when it is in its ideal shape.

Other aspects and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

Preferred exemplary embodiment of the invention are illustrated in the accompanying drawings in which like reference numerals represent like parts throughout, and in which.

DETAILED DESCRIPTION OF THE PREFERRED EMBODIMENTS

1. Resume

Figure 1:
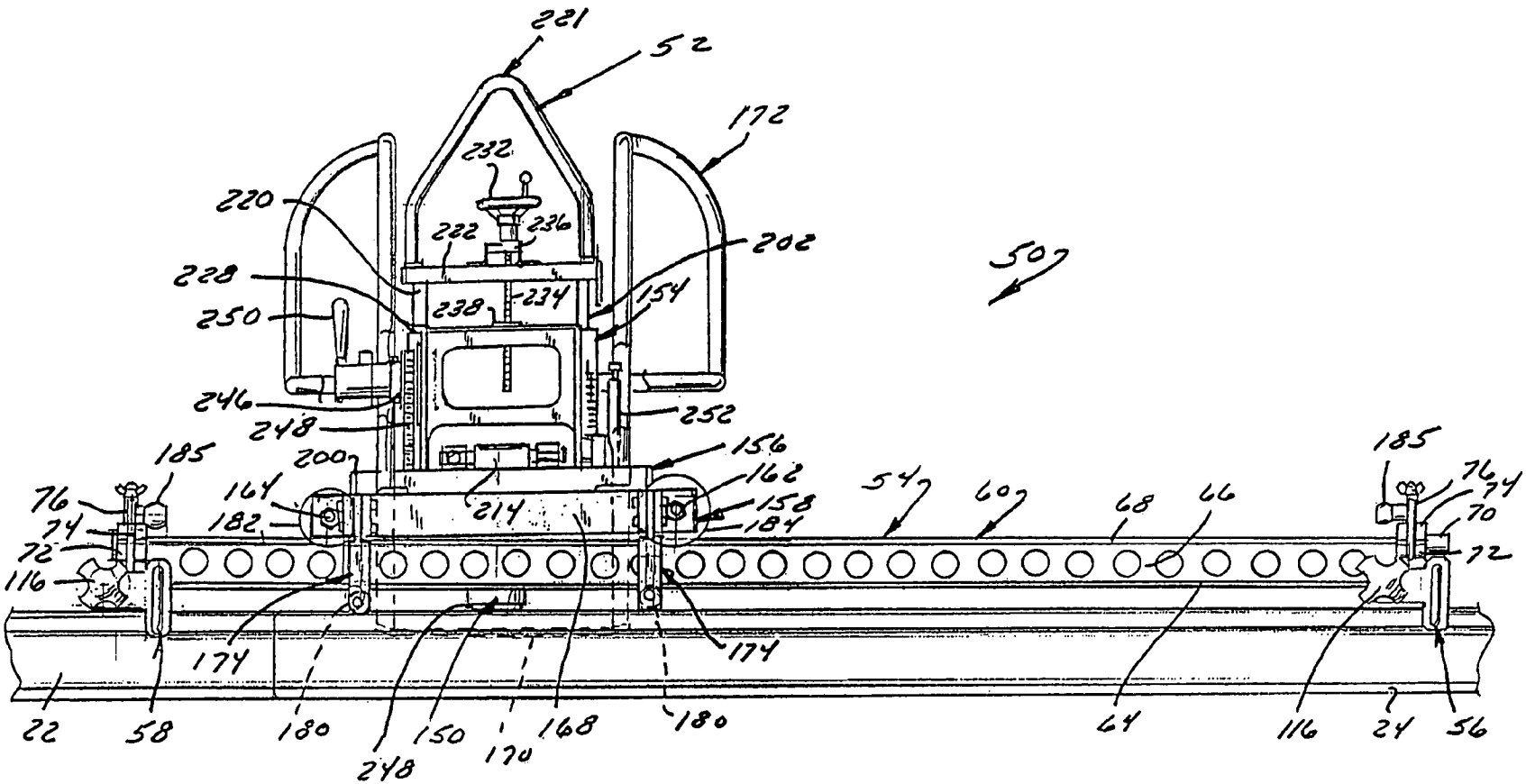
FIG. 1 is a side elevation view of a railway grinding system constructed in accordance with the preferred embodiment of the present invention and illustrating the system located over a railway frog.

Pursuant to preferred embodiments of the invention, a railway grinding system is capable of grinding a railway section in situ over a precisely defined path that is unaffected by the geometry of the railway section to be ground. The system includes a frame providing a reference path and a grinding machine movable along the reference path. Particularly preferred embodiments of the grinding machine are configured to grind frogs or other railway switches, but many concepts disclosed herein are applicable to machines configured to grind other railway sections as well.

In a particularly preferred embodiment in which the grinding machine is a frog grinder optimized to grind frogs but capable of grinding other switches and railway sections as well, the grinding machine includes a carriage mounted on guide rails of the frame for movement therealong, and the grinding tool is mounted on the carriage so as to be movable transversely, vertically, and rotationally relative to the carriage and guide rails. Because the grinding tool has at least four degrees of freedom with respect to the reference frame, it is extremely versatile and, therefore, can follow relatively convoluted contours. Versatility can be further enhanced by permitting one grinding tool, such a cup grinder suitable for grinding a generally horizontal surface of the railway, to be replaced with another grinding tool, such as a flange grinder suitable for grinding a generally vertical surface of the railway or a cup stone suitable for grinding a frog point or other tapered surface of the railway. The frog grinder can perform either single-event reconditioning grinding or periodic maintenance grinding.

As mentioned above, the frog grinder is optimized for grinding a railway frog. A typical frog 10 is illustrated in phantom lines in FIGS. 2 and 3. It includes a main casting which includes a throat 12, a point 14, and a heel 16. A main wheel-way extends from a main toe 18, along a wheel-supporting surface 20 of the toe, thence to the frog point 14 and a main heel rail 22 attached to the upper side of the heel 16. A crossing wheel-way extends from a crossing toe rail 24, along a wheel supporting surface 26 of the toe, thence to the frog point 14 to a crossing heel rail 28 attached to the side of the heel 16. Along side each wheel-way there is a channel flangeway 30, 32 to pass the flange of the rail wheel, and these channels cross at the throat 12 and pass along opposite sides of the point 14.

In the use of railway frogs, the greatest wear and battering of the surfaces typically occurs at and near the throat 12 and especially at the point 14, since these are the areas which receive greatest impact as car wheels run along the wheel ways and must cross the interruptions formed by the flange way channels 30 and 32. The end of the point 14 may be completely broken and battered, and the damage may extend far along its length. The wheel-way surfaces along the throat 12 may likewise be cracked and battered. Wear and battering can also occur at the ends of the heel 16 where the frog 10 joins the connected rails. The full length of the wheel-way surfaces 26-32 is subject to work-hardening. The greatest repair problems occur at and near the throat 12 and point 14, and to a lesser extent at the remote ends of the frog 10, but the work hardened metal along the intermediate surfaces may also require repair. Depending on the track-time available to the repair crew, the crew may resurface the frog with weld metal along substantially the entire lengths of the wheel-ways in a single operation, or may prioritize the grinding operation by repairing the most worn or battered sections of the frog in a single operation or intermittently over a period of time.

2. Construction of Grinding System

Figure 2:
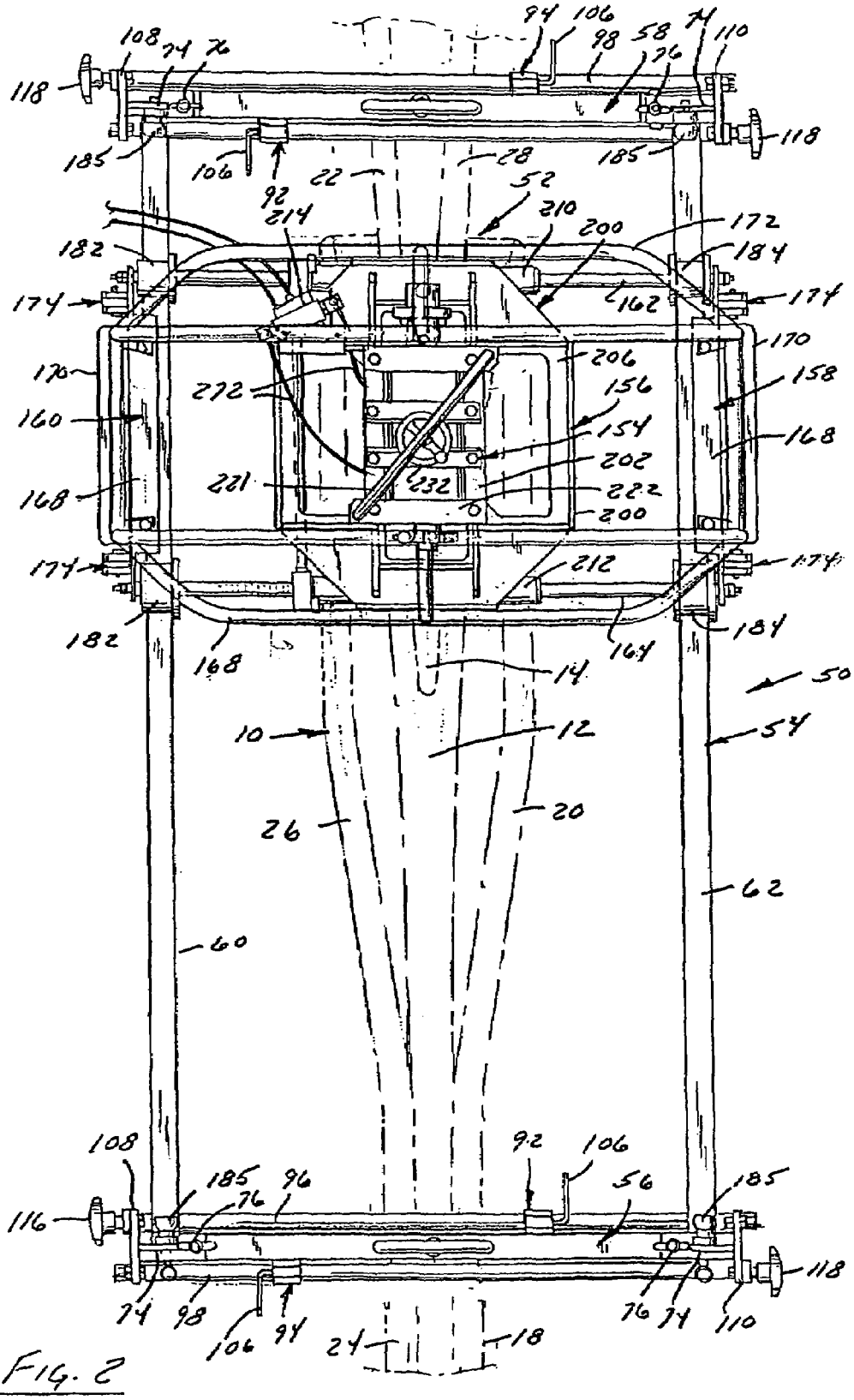
FIG. 2 is a top plan view of the railway grinding system and frog of FIG. 1.

Referring to FIGS. 1 and 2, a frog grinding system 50 constructed in accordance with an especially preferred embodiment of the invention includes a grinding machine 52 and a frame 54 that provides a reference path for grinding machine movement. The grinding machine 52 will be described in detail below in connection with FIG. 7+. The frame 54 is illustrated in FIGS. 1-6A. Referring initially to FIG. 2, the frame 54 includes end supports 56, 58 and at least one and preferably two guide rails 60, 62 that are supported on the end supports 56, 58 and that define the reference path for grinding machine movement. The end supports 56, 58 are supported on the railway at locations that are spaced from the ends of the track section to be repaired, hence eliminating the effects of the repaired railway section geometry on the reference path. When the machine 52 is used as a frog grinder, the supports 56, 58 are preferably spaced from each other by at least 6 to 8 feet and, more preferably, by about 10 feet or even more.

Referring particularly to FIG. 1, each guide rail 60, 62 may comprise any structure capable of 1) supporting the weight of the grinding machine 52 without deformation and 2) permitting the grinding machine 52 to move along the guide rails 60, 62. One or more tubes could perform this function. In the currently preferred embodiment, two gusseted, flanged rails are provided. Each guide rail 60, 62 has a base 64, a gusseted web 66, and an upper head 68. As is conventional, the head 68 has side flangeways for cooperation with corresponding flanges on the carriage wheels 182, 184 as detailed below. The head 68 should have an upper surface that is flat and that does not deform under the weight of the grinding machine 52, hence providing a precisely defined reference path for grinding machine movement. A metal rail having a machined head upper surface would be suitable for these purposes. Finally, each end of each guide rail 60, 62 terminates in a tubular post 70 for cooperation with clamps on the end supports 56 and 58 detailed below.

Figure 3:
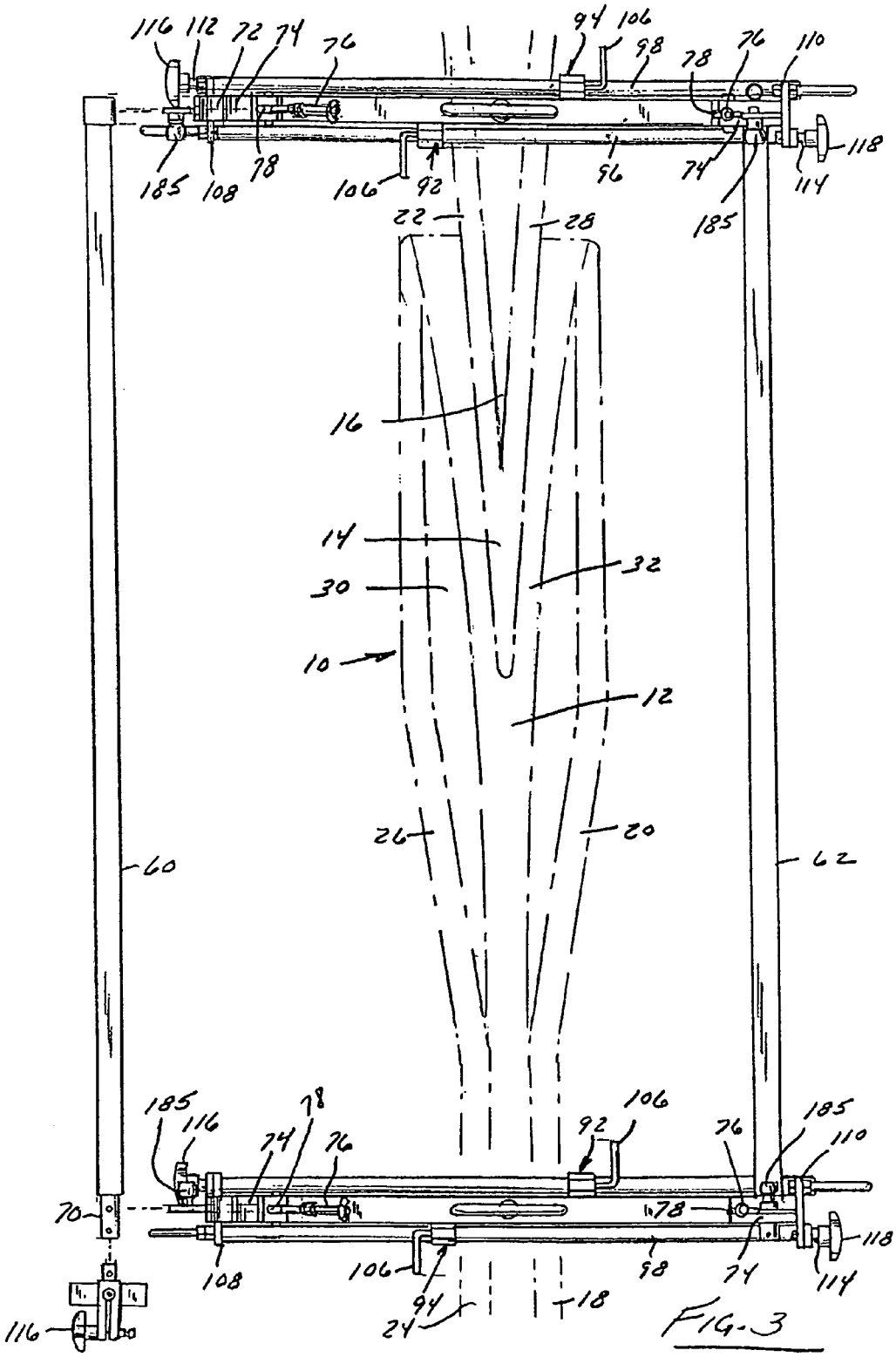
FIG. 3 corresponds to FIG. 2 but illustrates a frame of the system during an intermediate phase of assembly.
Figure 4:
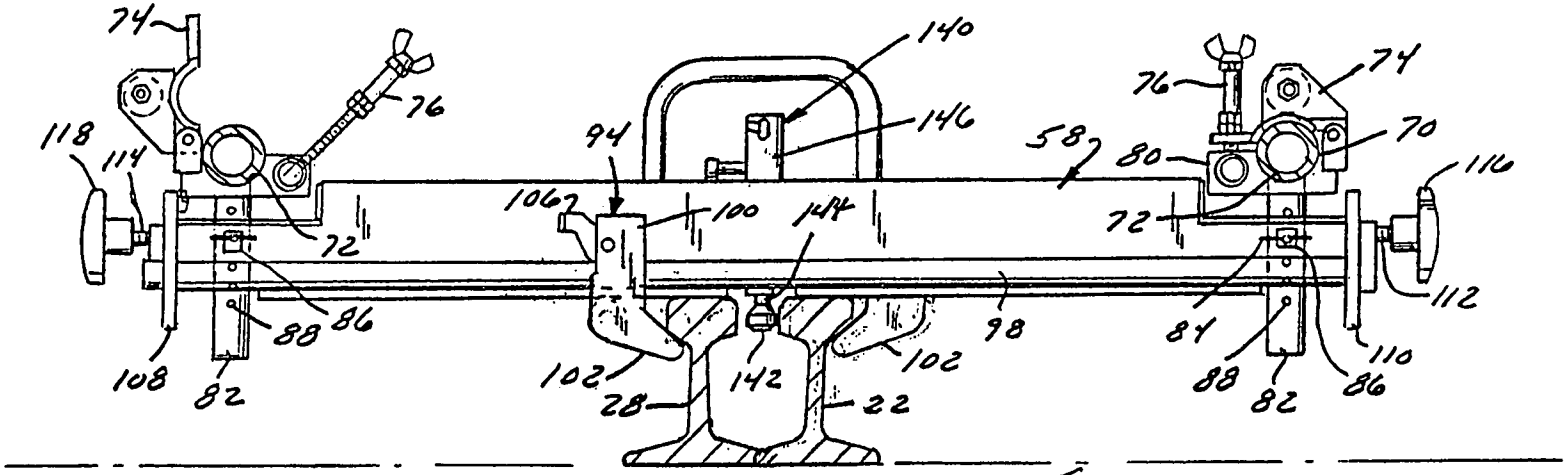
FIGS. 4 and 5 are left and right end elevation views, respectively, of the frame of FIG. 3 in its partially assembled state.
Figure 5:
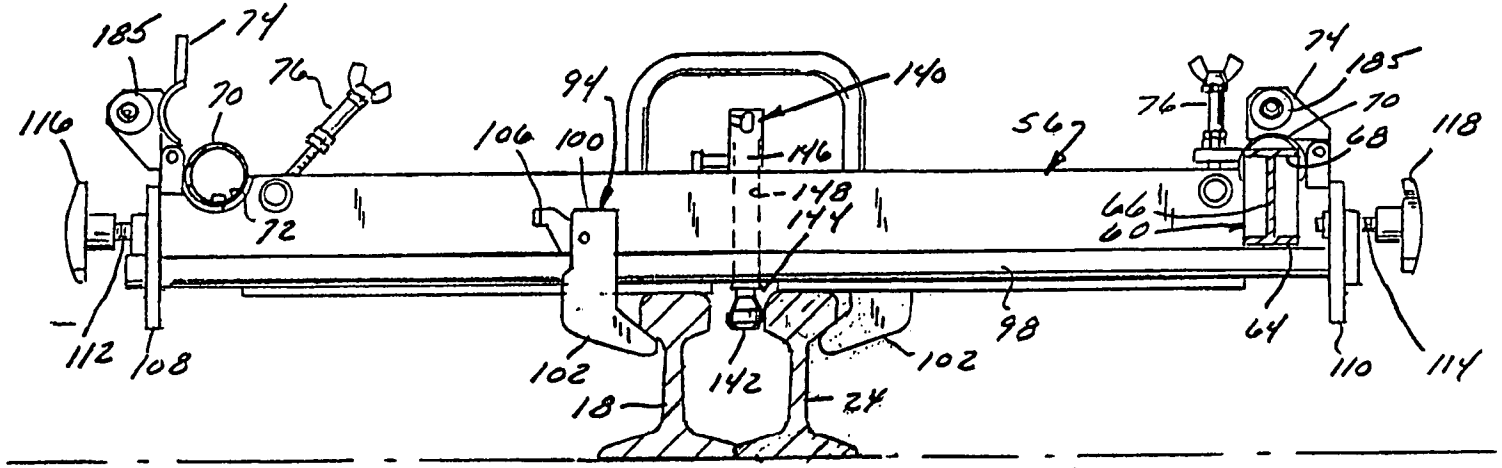

Referring specifically to FIGS. 3-5, each of the end supports 56, 58 preferably comprises a metal cross beam supported on top of the associated railway section. Each cross beam 56, 58 bears a clamp on its upper surface for receiving the end of an associated guide rail section. Each clamp comprises an arcuate cradle 72 and a pivoting strap 74. The cradle 72, formed from an arcuate recess in the supporting surface of the associated cross beam 56 or 58, supports the tubular post 70 of the associated guide rail 60 and 62. The strap 74 is pivotable between a released position permitting movement of the guide rail end post 70 into and out of the cradle 72 and a clamped position in which the strap 74 holds the post 70 against the cradle 72. Each strap 74 is lockable in its clamped position using a standard screw clamp 76 that engages a slot 78 on the end of the strap 74 as seen in FIG. 3.

In order to permit the reference path to be inclined relative to the railway in order to facilitate a sloped surface to be ground on the frog point 14 or another surface of interest, the clamps of at least one cross beam 56 or 58 are preferably vertically adjustable. Hence, referring to FIG. 4, the clamps at one end of the frame 54 are provide on top of a block 80 mounted on the upper end of a post 82. The post 82, in turn, extends downwardly through a vertical bore 84 in the cross beam 56 or 58. The position of each post 82 relative to the cross beam can be adjusted by inserting a pin 86 horizontally through a horizontal bore in the cross beam and through a selected one of a plurality of vertically spaced bores 88 in the post 82.

Figure 6:
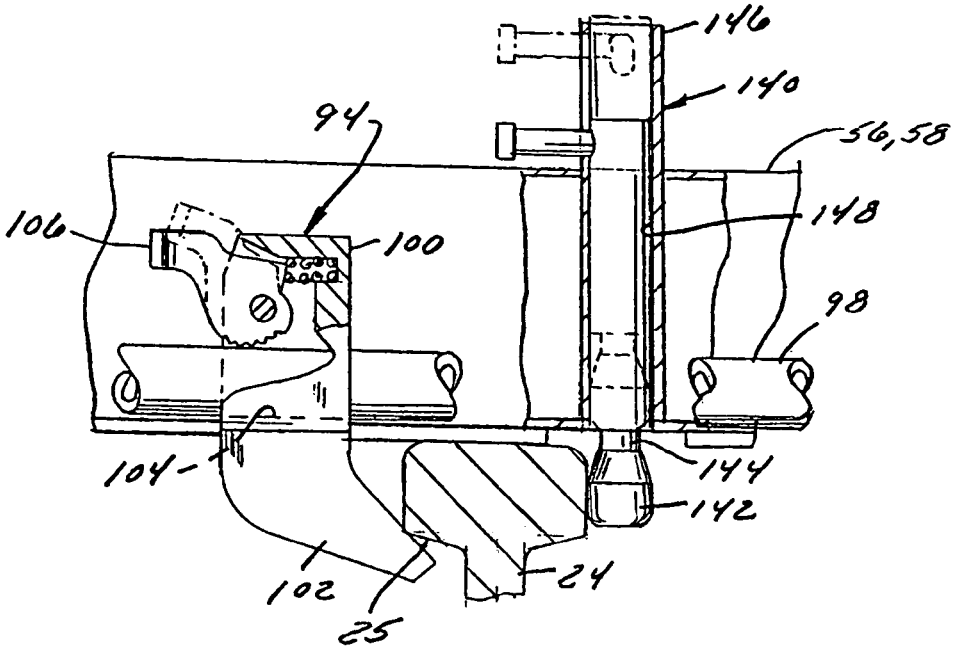
FIG. 6 is a detail view illustrating the clamping of one end of a crossbeam of the frame of FIGS. 2-5 to an associated rail.
Figure 6A:
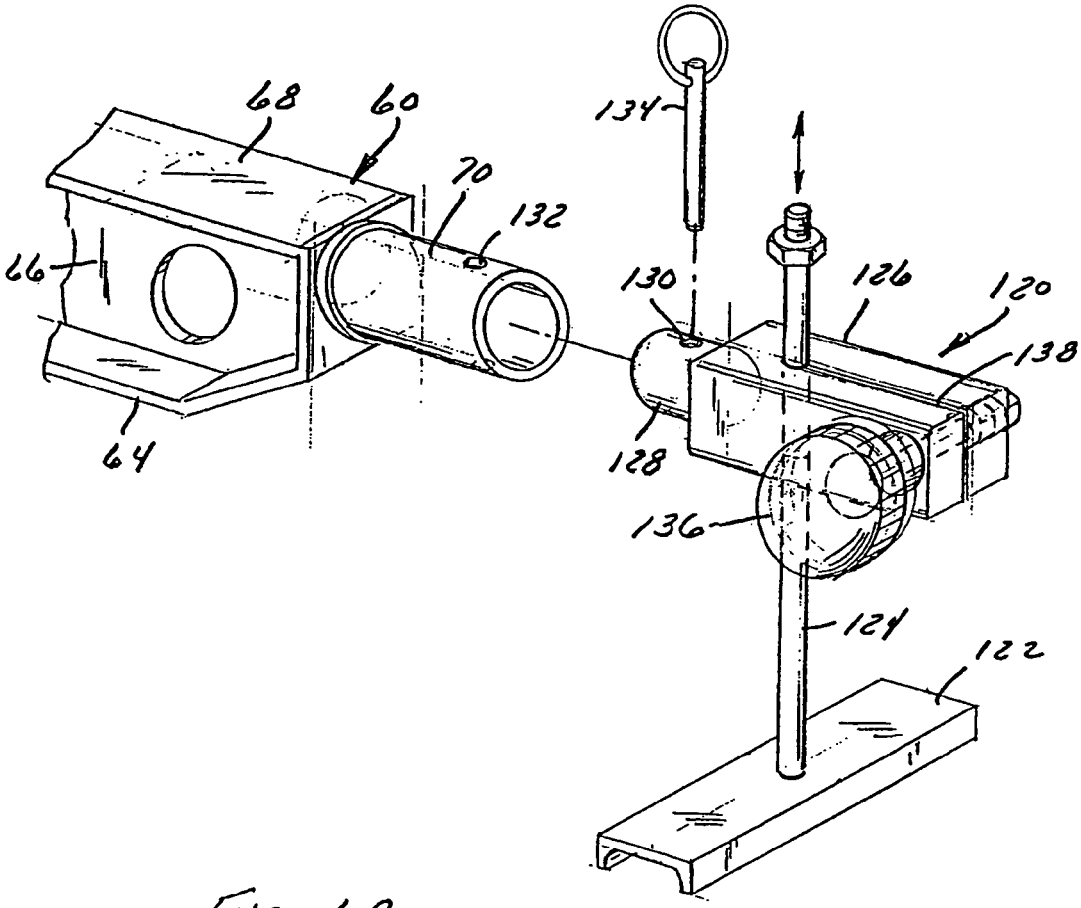
FIG. 6A illustrates an alternative mechanism for supporting a portion of the frame of FIGS. 2-4.

Referring to FIGS. 3-6, each cross beam 56, 58 is clamped on the railway section by a clamp assembly. Preferably, each clamp assembly is configured to permit coarse positioning of the cross beam at a desired location, followed by fine adjustment of cross beam position. The coarse positioning is achieved using dog clamps 92, 94. Each dog clamp 92, 94 is mounted for movement along an associated guide rod 96, 98 mounted on the cross beam 56, 58. One of the guide rods 96 is positioned inside of the cross beam, and the other guide rod 98 is positioned outside the cross beam. As best seen in FIG. 6, each of the dog clamps 92 and 94 comprises a sliding support 100 and an engagement arm 102. The engagement arm 102 is inclined downwardly and inwardly towards the rail so as to engage the lower surface of the flangeway 25 of the associated rail head upon clamp engagement as best seen in FIG. 6. The support 100 comprises a metal block having a horizontal bore 104 formed therethrough that slidably receives the associated guide rod 96 or 98. The support 100 of each clamp 92, 94 is selectively lockable to the associated guide rod 96, 98 by a spring loaded cam 106 as best seen in FIG. 6.

Still referring to FIGS. 3-6, the opposed ends of the guide rods 96, 98 are mounted on end plates 108, 110 extending transversely across the ends of the associated cross beams 56, 58. Each end plate 108, 110 is mounted on the cross beam by a screw adjuster 112, 114 that permits limited movement of the cross beams 56, 58 relative to the end plates 108, 110. With the guide rods 96, 98 locked in position by the dog clamps 92, 94, the screw adjusters 112, 114 can be adjusted by manipulation of associated hand wheels 116, 118 to move the cross beams 56, 58 and guide rails 60, 62 transversely with respect to the guide rods 96, 98 and the railway section to fine tune guide rail position.

It may be necessary in some circumstances, such as when a frog is removed from the railway section for reconditioning, to support one end of one or both of the guide rails 60, 62 at a location that is spaced from the railway, hence prohibiting use of a cross beam. The eventuality is accommodated using an outrigger 120 illustrated in FIG. 6A. The outrigger 120 comprises a base 122, a post 124 extending upwardly from the base 122, and a clamp mounted on the post 124. The clamp includes a block 126 and a stud 128 extending forwardly from the front end of the block 126. The stud 128 is dimensioned to be received within the tubular end post 70 of the associated guide rail (60 in the illustrated example). The stud 128 has a through-bore 130 alignable with a corresponding through-bore 132 in the guide rail end post 70 to permit the guide rail to be coupled to the stud 128 using a cotter pin 134 or the like. The height of the guide rail 60 relative to the base 122 can be adjusted by a screw clamp 136 that is mounted on the block 126. The screw clamp 136 is operable to expand and contract a slot 138 in the block 126 upon being tightened or loosened, thereby selectively 1) tightening the block 126 against the post 124 to lock it in position and 2) loosening the block 126 sufficiently to permit it to move vertically along the post 124 in the direction of the arrow in FIG. 6A.

A mechanism may be provided to facilitate positioning of each cross beam 56, 58 at a location setting a desired angular relationship between a longitudinal centerline of the frame 54 and a longitudinal centerline of the frog 10. Referring to FIGS. 4-6, this mechanism preferably comprises a retractable stop 140 configured to be positioned between the associated rail portions 18 and 24 or 22 and 28 of the railway section. Each stop 140 comprises a bumper 142 mounted on the bottom end of a pin 144. The pin 144 extends downwardly through a sleeve 146 mounted over a vertical bore 148 in the associated cross beam 56 or 58. The pin 144 is mounted in the sleeve 146 so as to permit the pin 144 to be selectively retracted within the bore 148 to move the bumper 142 from an extended position as seen in solid lines in FIG. 6 to a retracted position in which the bumper 142 is located above the bottom of the cross beam 56 or 58, thereby permitting the cross beam to be mounted in a location in which the center of the cross beam can rest on a rail or other structure.

Turning now to FIGS. 6-10, the grinding machine 52 includes a grinding tool 150 that is supported so as to be movable through four degrees of freedom with respect to the guide rails 60 and 62, namely:

Longitudinally with respect to the guide rails,
Laterally with respect to the guide rails,
Vertically with respect to the guide rails,
Rotationally with respect to the guide rails.

In the preferred embodiment, this versatility is achieved by mounting the grinding tool 150 on a chuck 152 that is rotatably mounted on a workhead 154. The workhead 154, in turn, is movable vertically and laterally relative to a carriage 156. The carriage 156, in turn, is movable longitudinally relative to the guide rails 60, 62. The carriage 156, workhead 154, chuck 152, and grinding tool 150 will now be described in turn.

Still referring FIGS. 6-10, the carriage 156 comprises first and second transversely spaced, laterally extending support beams 158, 160 and first and second longitudinally spaced, transversely extending axles 162, 164 connecting adjacent ends of each of the opposed support beams 158, 160 to one another. As best seen in FIGS. 1, 7, 10, and 11, each of the support beams 158 and 160 comprises an L-beam having a vertical leg 166 positioned outside of a field side of the associated guide rail 60 or 62 and a horizontal leg 168 projecting inwardly from the upper end of vertical leg 166 in an overlying relationship with the associated guide rail 60 or 62. Feet 170 may be mounted on the bottom of the support beams 158 and 160 for supporting the carriage 156 on the ground prior to its mounting on the guide rails 60 or 62. A roll cage assembly 172 is mounted on top of the support beams 158, 160 for preventing damage to the grinding machine 52 should it tip over during transport.

Figures 7, 8:
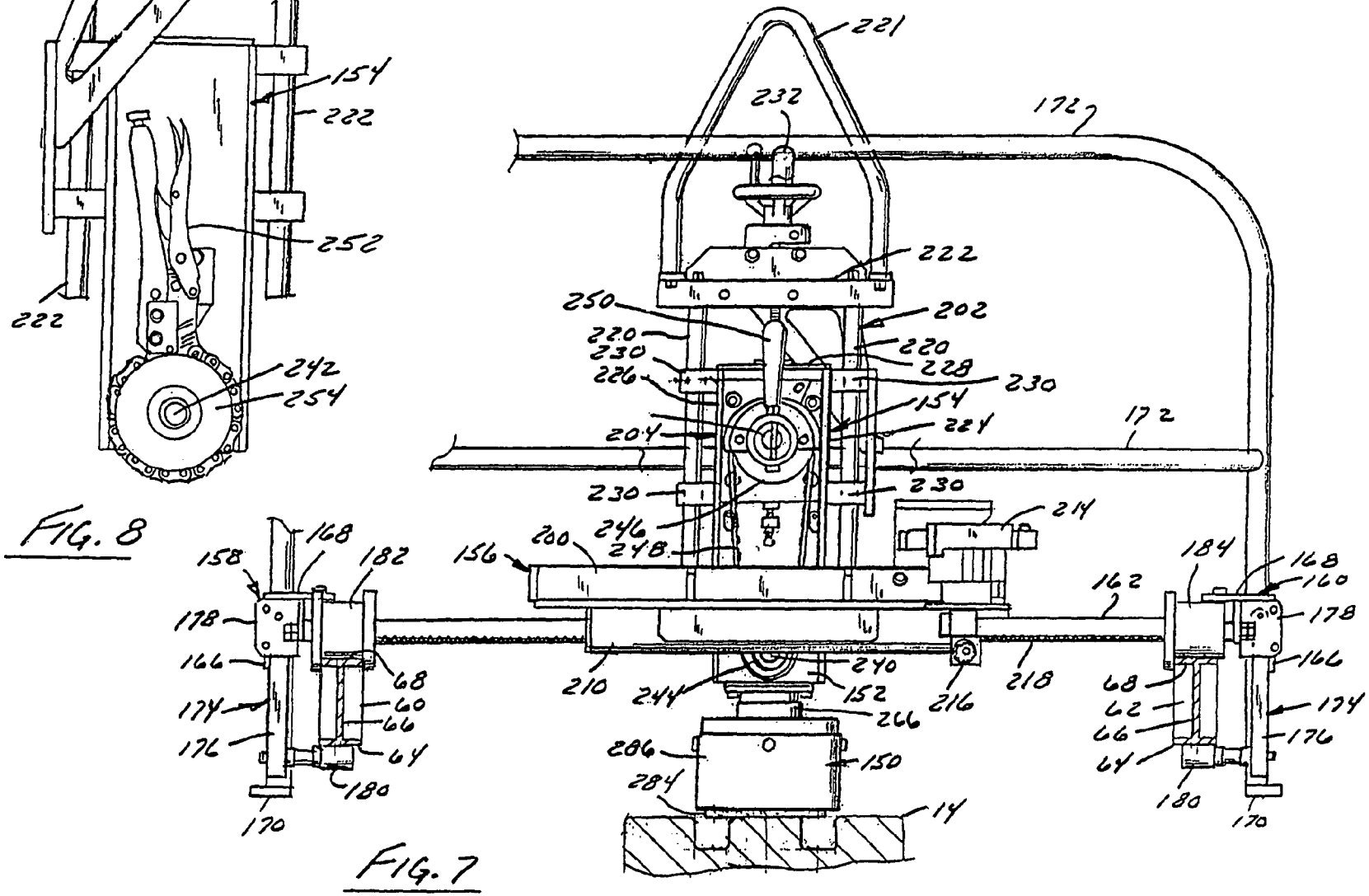
FIG. 7 is an end elevation view of a grinding machine of the system of FIGS. 1 and 2.
FIG. 8 is an end elevation view of a clamp for selectively locking a chuck of the grinding machine in a desired rotational position relative to the remainder of the grinder.
Figure 10:
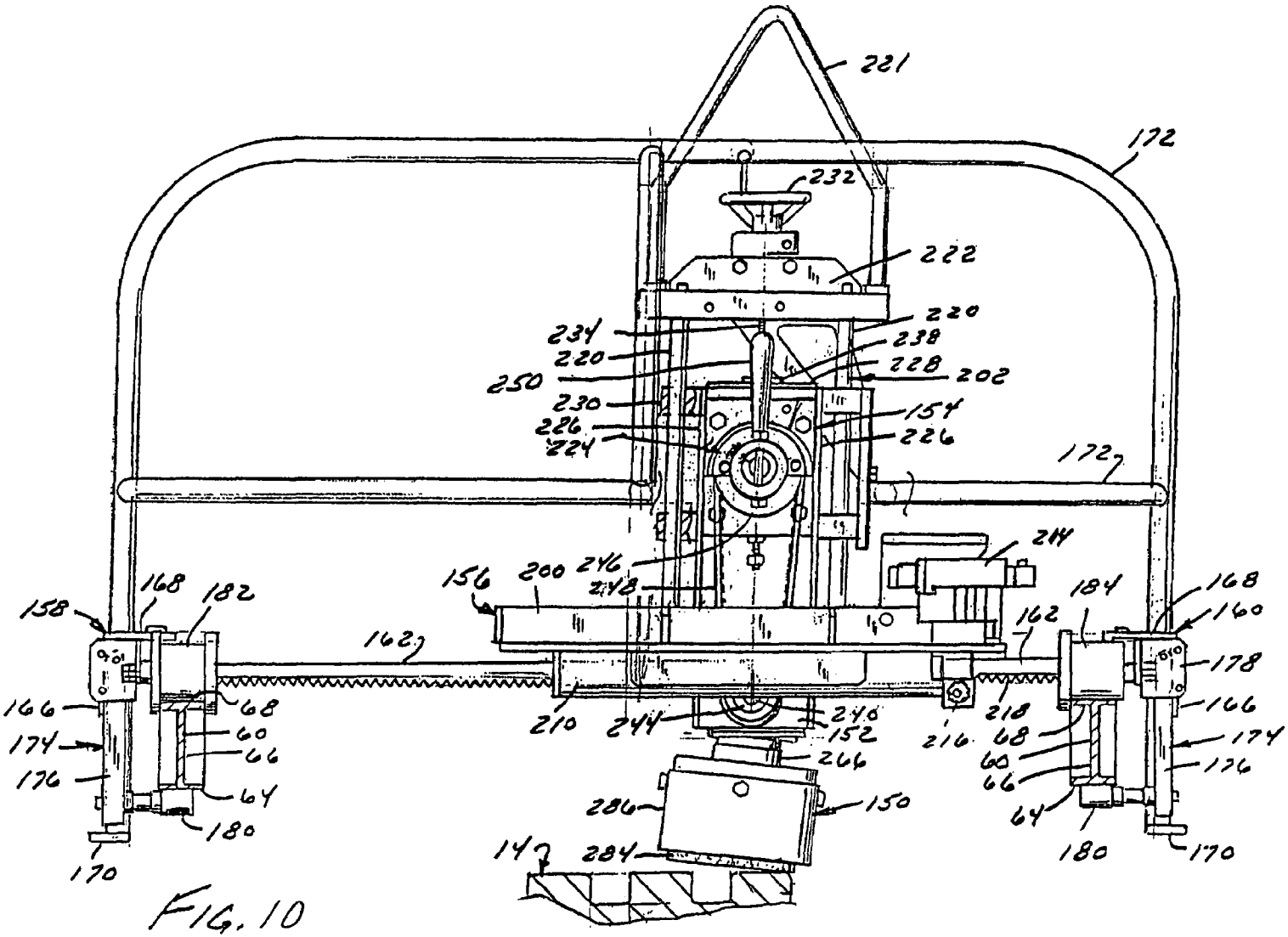
FIG. 10 corresponds to FIG. 9 and illustrates a chuck of the grinding machine in a rotated position.
Figure 11:
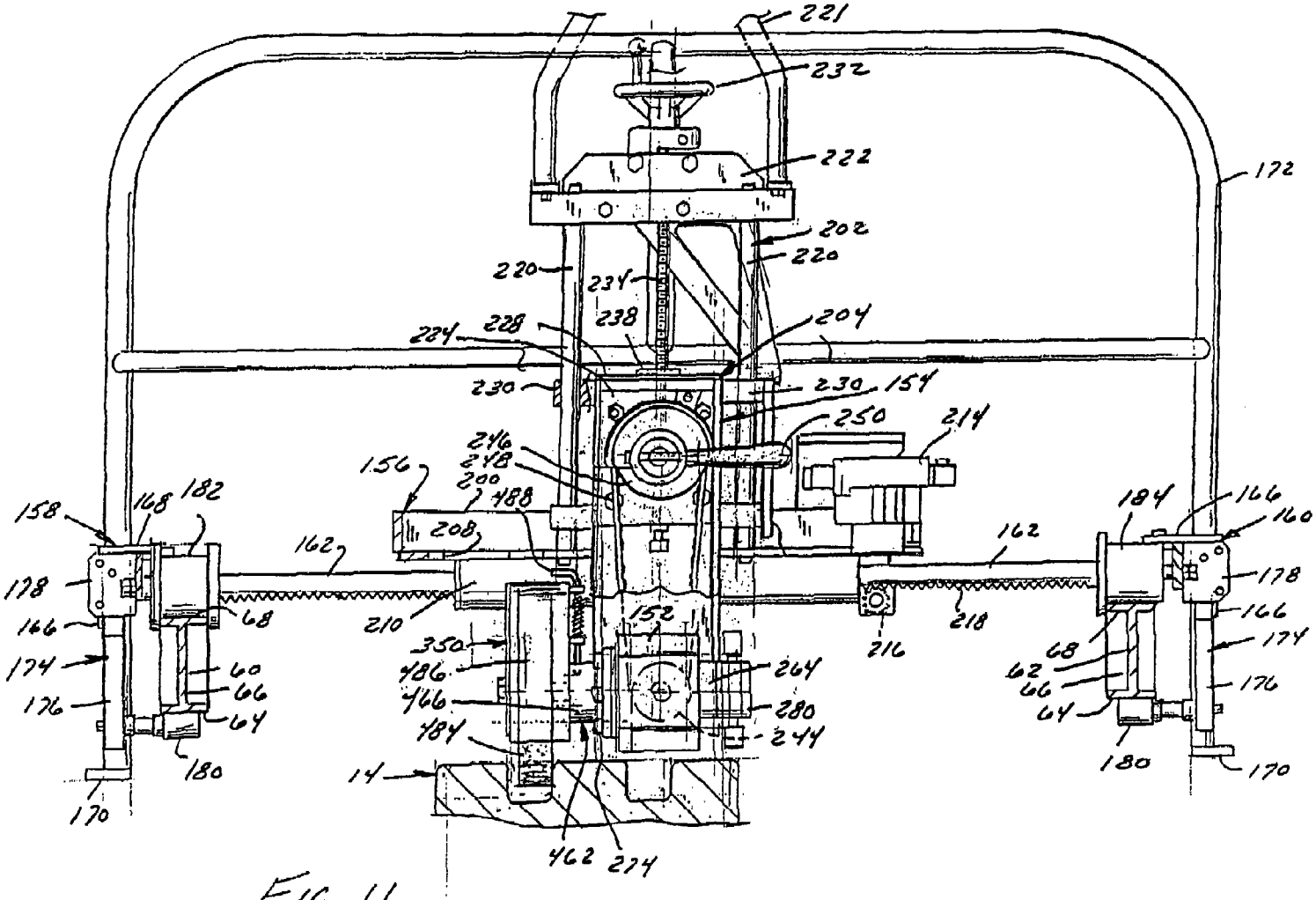
FIG. 11 corresponds to FIG. 9 but illustrates the grinding tool of the grinding machine as being replaced with another grinding tool configured to perform a different type of grinding operation.

The opposite ends of each of the support beams 158 and 160 are mounted on a hold down 174 as seen in FIGS. 7, 10, and 11. Each hold down 174 comprises a vertically extending arm 176, a block 178 mounted on the upper end of the arm 176, and a hold down roller 180 mounted on the lower end of the arm 174. The vertical leg 166 of the associated support beam 158, 160 is mounted on the block 178. The hold down roller 180 extends beneath the base of the associated guide rail 60, 62 to engage the bottom of the guide rail. This roller, coupled with the carriage wheels 182, 184 described below, clamp the carriage 156 to the guide rails 60, 62 to prevent the carriage 156 from bouncing or moving up and down relative to the guide rails 60, 62 during a grinding operation.

Figure 9:
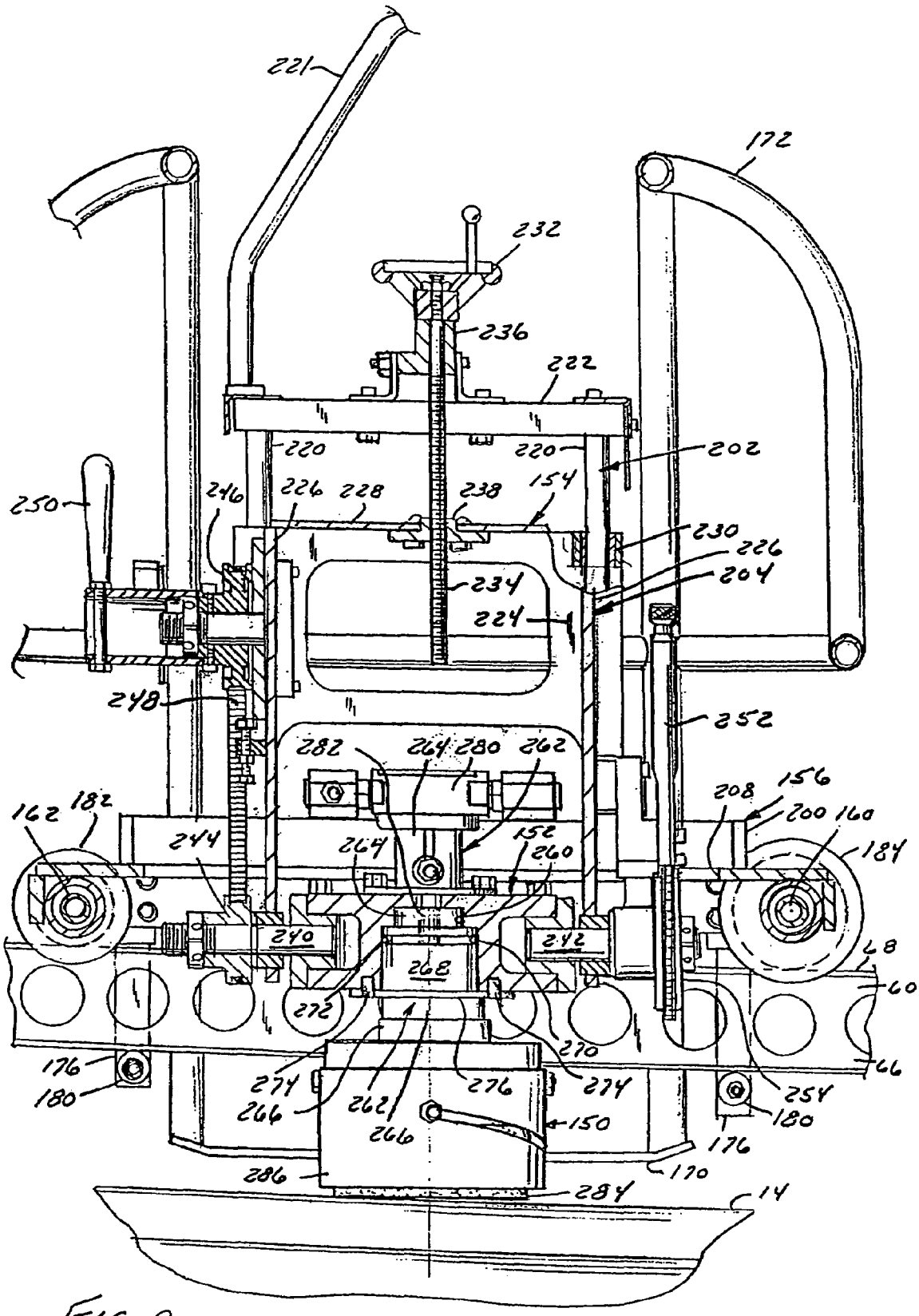
FIG. 9 is a side elevation view of the grinding machine.

Each of the axles 162, 164 comprises steel tubes mounted on the vertical legs of the support beams 158 and 160 as seen in FIGS. 2 and 9. Each axle 162, 164 receives a pair of opposed flanged wheels 182, 184 that are supported on the respective guide rails 60, 62 to permit the carriage 156 to roll along the guide rails 60, 62. As best seen in FIGS. 7 and 10, the wheels 182 on one side of the grinding machine 52 are preferably flanged at both axial ends, whereas the wheels 184 on the opposite side of the grinding machine 52 only need flanged on one axial end in order to prevent undesired lateral movement of a carriage 156 relative to the guide rails 60, 62. Movement of the wheels 182, 184 along the guide rails 60 and 62 is limited by bumpers 185 mounted on the straps 74.

Referring now to FIGS. 1, 2, 7, and 9, the workhead 154 includes a platform 200, a tool holder support 202 mounted on the platform 200, and a tool holder 204 that is movably mounted on the tool holder support 202 and that movably supports the chuck 152. The platform 200 includes a generally rectangular base 206 having a center opening 208 through which the tool holder 204 passes. Transversely extending guide bushes 210 and 212 are mounted on the bottom of the opposed longitudinal ends of the base 206 and, in turn, are supported on the carriage axles 162, 164. A hydraulic motor 214 is mounted on the base 206 adjacent one of the guide bushes 210. The motor 214 can be selectively operated by a valve assembly (shown the same module with the motor 214) to drive a pinion 216 to rotate against a rack 218 to drive the platform 200 along the axles 162, 164. The rack 218 may be mounted on one of the axles or, as in the illustrated embodiment, may be formed integrally with the bottom surface of the associated axle 162. The hydraulic motor 214 could be replaced with any other suitable mechanism for selectively moving the platform 200 laterally relative to the carriage 156, such as a manually actuated ratchet mechanism.

Still referring to FIGS. 1, 2, 7 and 9, the tool holder support 202 includes four guide rods 220 extending upwardly from the platform 200 and a cap 222 formed from a rectangular frame mounted on the upper ends of the guide rods 220. A lift cage 221 is mounted on the upper surface of the cap 222 to permit grinding machine lifting and transport. Alternatively, the lift cage 221 could be separated from the workhead 154 and attached to or incorporated into the roll cage assembly 172. The tool holder 204 comprises a rectangular frame having apertured longitudinal and transverse sidewalls 224 and 226 and an upper plate 228 welded to the upper edges of the sidewalls 224 and 226. Sleeves 230 are mounted on the corners of the longitudinal sidewalls 224 for sliding movement along the guide rods 220. A manually operated screw assembly drive is mounted on the cap 222. It includes an adjusting wheel 232 and a threaded rod 234. The threaded rod 234 extends downwardly through a collar 236 mounted over a center opening in the cap 222. As best seen in FIG. 1, the bottom end of the threaded rod 234 extends downwardly through a threaded collar 238 on the plate 228 so that the tool holder 204 moves vertically relative to the tool holder support 202 upon rod rotation. Graduated indicia (not shown) may be located adjacent one of the guide rods 220 to provide a visual indication of the height of the tool holder 204 relative to the tool holder support 202 during adjusting wheel operation.

Referring now particularly to FIGS. 8 and 9, chuck 152 is located in the hollow interior of the tool holder 204. The chuck 152 is supported on the tool holder 204 by a pair of stub shafts 240, 242, each of which extends outwardly from the chuck 152 and is supported on a bearing mounted in an opening in an associated longitudinal sidewall 206 of the tool holder 204. The chuck 152 is mounted on the inner ends of the stub shafts 240, 242 so as to rotate with the stub shafts. The outer end of one of the stub shafts 240 supports a driven pulley 244. The driven pulley 244 is coupled to an overlying drive pulley 246 by a drive belt 248. The drive pulley 246 can be selectively driven to rotate by a manual crank 250, thereby rotating the chuck 152 and grinding tool 150 about an axis extending in parallel with the guide rails 60, 62 (compare FIG. 9 with FIG. 10). The chuck 152 is preferably rotatable at least 90° to either side of a vertical plane in order to facilitate grinding tool replacement and to permit flanges on either side of the frog 10 to be ground without having to reverse the orientation of the grinding machine 52 on the guide rails 60, 62. Referring especially to FIG. 8, the chuck 152 can be selectively clamped in any desired rotational position using a manually actuated chain clamp 252 that can selectively release and clamp against a wheel 254 on the outer end of the stub shaft 242, hence selectively locking the stub shaft 242 and the chuck 152 as a whole from rotation. Indicia (not shown) can be located adjacent the hand crank 250 to provide the operative precise indication of the angular position of the chuck.

Referring particularly to FIG. 9, the chuck 152 has a through-bore 260 that receives the grinding tool 150. Preferably, the grinding tool 150 is mounted on a module 262 that is removably mounted in the through-bore 260 in a manner that permits replacement of a first module supporting one type of grinding tool with a second module supporting a second grinding tool of another configuration. For instance, in the illustrated embodiment, the module 262 supports a 4" or 6" cup grinder 150, which is well-suited for grinding the upper surface of the frog 10 but not for flanges or other side surfaces. The module 262 can be replaced with another module 462 supporting an 8" flange grinder 350 as best seen in FIG. 11 to grind vertical surfaces. It could also be replaced with still other modules, such as one supporting a 3" cup stone for grinding the frog point.

The grinding module 262 includes a top cap 264, a bottom cap 266, and a bearing housing 268 located between the top and bottom caps 264 and 266. The top cap 264 and bearing housing 268 are positioned in the bore 260. The bottom cap 266 extends downwardly beneath the bottom of the chuck 152 and receives the cup grinder 150. The grinding module 262 is retained in the chuck 152 by a pin 270 extending through a bore in the chuck and into a groove 272 in the outer periphery of the top cap 264. Module rotation is prevented by dowels 274 that extend through bores in a flange 276 of the bottom cap and into corresponding bores in the bottom of the chuck 152. Due to this arrangement, the grinding module 262 can be replaced with another grinding module simply by removing the pin 270 and withdrawing the module 262 from the bore 260.

Still referring to FIG. 9, the grinding tool 150 is driven to rotate by a hydraulic motor 280 mounted over the bore 260. The motor 280 has an output shaft 282 that meshes with an input shaft (not shown) of the grinding tool 150 when the grinding tool is mounted in the bore 260. The cup grinder forming the grinding tool 150 comprises the aforementioned input shaft, a grinding wheel 284 mounted on the output of the shaft, and a cup guard 286 that surrounds the grinding wheel 284. The grinding wheel 284 extends beyond the bottom surface of the cup guard 286 to present a flat bottom grinding surface for engagement with the work surface of the railway.

Comparing FIG. 9 to FIG. 11, the module 262 supporting the cup grinder 150 can be replaced with another module 462 supporting a flange grinder 350 when the chuck 152 is rotated to a horizontal or near horizontal position. The module 462 includes a top cap 464, a bottom cap 466, and a bearing housing 468 located between the top cap 464 and bottom cap 466, similar to the module 262, and is mounted in the bore 260 using the same pin 270 used to mount the module 262 in the bore 260. Alternatively, the module 462 could be formed from two pieces. For example, either the top cap 464 or the bottom cap 466 could be formed integrally with the bearing housing 468. It is also restrained from rotation using the same dowels 274. The flange grinder 350 includes a grinding wheel 484 mounted on the module's output shaft, and a guard 486 that surrounds the grinding wheel 484. The guard 486 is arcuate, having an enclosed outer end surrounding most of the circumference of the grinding wheel 484, leaving the bottommost surface of the grinding wheel 484 exposed for grinding contact with the work surface. The guard 486 is mounted on the module 462 so as to permit it to be repositioned on the module 462 to expose the opposite side of the grinding wheel 484 when the chuck 152 is rotated 180° from the position as illustrated in FIG. 11. Specifically, a locator pin 488 on the guard 486 can be selectively retracted and extended to permit the locator pin 488 to be withdrawn from a first opening in the bottom cap 466 and inserted into a second, opposed opening after the guard 486 is rotated about the module 462.

3. System Assembly and Operation

Operation of the grinding system 50 described above will now be described in conjunction with the in situ grinding of a reconditioned frog 10, it being understood that it could be used to grind other types of switches and even other types of railway sections either as part of a reconditioning process or as a separate maintenance process. It could also be used to grind a frog that has been removed from the railway.

Prior to assembling the system 50, the point 14 and other sections of the frog 10 requiring repair are welded in-situ to repair any cracked or damaged sections and to build the vertical and horizontal wheel contacting surfaces of the frog 10 to dimensions beyond desired final dimensions. The frame 54 and grinding machine 52 are then transported to the worksite. The cross beams 56 and 58 are then supported on railway sections that are unaffected by the geometry of the repaired frog 10, and the tubular ends 70 of the guide rails 60, 62 are clamped to the cross beams 56, 58 using the clamps 76. If a particular application requires the grinding of an incline on the point 14 or other surface of the frog 10, one end of the guide rails 60, 62 can be positioned below the other by suitable adjustment of the adjusting posts 82 of FIG. 4. The frame 54 may then clamped to the railway using the dog clamps 92, 94 and screw adjusters 112, 114 so that the longitudinal centerline of the frame 54 extends off-line relative to the longitudinal centerline of the frog 10, thereby facilitating the grinding of frog surfaces that extend at an angle relative to the frog's longitudinal centerline. Hence, one of the cross beams 56, 58 may be positioned so that the bumper 142 of the associated retractable stop 140 engages the gauge side flangeway of a rail on one side of the frog's centerline, and the opposite cross beam 58, 56 may be positioned such that bumper 142 of the associated retractable stop 140 engages the gauge side flangeway of the rail on the opposite side of the frog's centerline. The cross beams 56, 58 are then locked against the rails by actuation of the dog clamps 92, 94. Any remaining fine adjustment required at this time or during the rail grinding operation can be performed using the screw adjuster 112, 114.

After the frame 54 is fully assembled and positioned as desired, the grinding machine 52 is mounted on the guide rails 60, 62. Assuming initially that horizontal surfaces of the frog 10 are to be ground, the grinding machine 52 is fitted with the cup grinder 150 of FIGS. 1, 2, and 7-10 prior to this mounting. The carriage 156 is then pushed manually along the guide rails 60, 62 to the section of interest, and the hydraulic motor 214 is actuated to drive the workhead 154 along the axles 162, 164 to the desired lateral position. The grinding tool 150 is positioned vertically, laterally, and rotationally as desired through suitable operation of the hydraulic motor 214, the adjuster wheel 232, and the hand crank 250. The desired section of the frog 10 is then ground while moving the carriage 156 relative to the guide rails 60, 62, moving the workhead 154 relative to the carriage 156, and/or moving the chuck 152 relative to the workhead 154 as required to obtain the desired orientation and position of the grinding tool 150 relative to the frog section being ground. Hence, the cup grinder 150 can be positioned to grind a horizontal surface of one frog segment as seen in FIG. 9 or repositioned to grind a beveled edge or inclined surface of the same or different segment as seen in FIG. 10.

All of this movement occurs with respect to a reference path set by the position of the guide rails 60, 62. As indicated previously, the reference path is completely unaffected by frog geometry. It can, however, be adjusted relative to the longitudinal centerline of the frog 10 by releasing the clamp assemblies and repositioning the cross beams 56, 58 as desired. It can also be adjusted vertically by adjustment of the vertical posts 82 of FIG. 4.

The procedures described above works well to grind the point 14 or other upper surfaces of the frog 10 or the edge of the frog adjacent those surfaces. Referring to FIG. 11, vertical surfaces, such as the flanges, can be ground by replacing the cup grinder 150 of FIGS. 1, 2, and 7-10 with the flange grinder 350 of FIG. 11. Specifically, the adjuster wheel 232 is actuated to move the chuck 152 vertically to a position well above the frog 10, the clamp 252 is released, and the hand crank 250 is rotated to rotate the chuck 152 from the generally vertical orientation of FIGS. 6-10 to the generally horizontal orientation of FIG. 11. The pin 270 is then removed, and the cup grinder module 262 of is replaced with the flange grinder module 462. The flange grinder 350 is then repositioned over the flange or other vertical surface to be ground, and the adjuster wheel 232 is actuated to lower the flange grinder to the position illustrated in FIG. 11 in which it engages and grinds a flange or other generally vertical surface of the frog 10.

As discussed briefly above, the grinding process described above can be performed as required during routine maintenance, ether as the frog 10 wears is damaged or in association with an on-going work hardening process of a new frog. It also can be performed as a final step of an in-situ reconditioning process in which the wheel contacting surfaces of the frog 10 are built up by welding to remove undulations in the frog, and the frog 10 is then ground to a desired profile. Preferably, this grinding is not performed all in one operation but, instead, is performed incrementally over time such that the frog is initially ground from its initial profile to a profile intermediate to the final profile. The grinding process can then be repeated periodically during the work hardening process in the same manner as with a new frog. By coordinating maintenance grinding with the work hardening process, the work hardening process can be relied upon to produce a work-hardened frog having a geometry that precisely matches the ideal geometry of the frog. In addition, because the frog 10 can be precisely ground in-situ, the need to change out a frog, remove, or transport to an outside grinding facility, weld and grind it, and then changing it back in is completely eliminated.

To the extent that they might not be apparent from the above, the scope of variations falling within the scope of the present invention will become apparent from the appended claims.

We claim:

1. A rail frog grinding system comprising:

(A) a frame that is capable of being secured to a railway in situ at locations that flank opposed ends of a frog of a railway, said frame defining a reference path for grinding the frog and including:

(1) first and second longitudinally spaced transverse supports, each of which is configured to be supported on at least two spaced rails of the railway;

(2) first and second clamp assemblies, each of which is configured to releasably clamp a respective one of said supports to rails of said railway; and (3) at least one longitudinal guide rail that extends between and is supported on said transverse supports, a reference path being determined by the position of said guide rail, wherein said guide rail is sufficiently long to prevent the reference path from being influenced by the geometry of the frog; and (B) a grinding machine including a chuck and a rotating grinding tool that is supported on said chuck, said chuck being supported on the guide rail so as to have at least four degrees of freedom with respect thereto, thereby permitting said grinding tool to move relative to said guide rail to grind the frog.

2. The rail frog grinding system as recited in claim 1, wherein two of said guide rails are provided and are transversely spaced from one another so as to laterally flank the frog during a grinding operation, and wherein said grinding machine further comprises a carriage that supports said chuck on said guide rails.

3. The rail frog grinding system as recited in claim 2, wherein said chuck is movable linearly transversely of said guide rails and in parallel with said guide rails in order to permit said grinding tool to grind a tapered surface of the frog.

4. The rail frog grinding system as recited in claim 2, wherein said chuck is movable vertically relative to said guide rails in order to permit a grinding depth of said grinding tool to be varied.

5. The rail frog grinding system as recited in claim 2, wherein said carriage comprises a platform that is supported on said guide rails for parallel and transverse movement with respect thereto, and wherein said chuck is supported on said platform for vertical movement relative thereto.

6. The rail frog grinding system as recited in claim 5, wherein said chuck is rotatable relative to said platform about an axis that is generally parallel to said guide rails.

7. The rail frog grinding system as recited in claim 1, wherein said chuck is movable vertically, transversely, longitudinally, and rotatably relative to said guide rail.

8. A rail grinding system comprising:

(A) a frame that is capable of being secured to a railway in situ at locations that are spaced from opposed ends of a deformed section of the railway to be ground, said frame defining a reference path; and (B) a grinding machine that is mounted on said frame so as to be movable therealong to grind the railway section along a path defined at least in part by said reference path, said frame being sufficiently long to prevent the reference path from being influenced by the railway section geometry, wherein said frame comprises at least one longitudinal guide rail that supports said grinding machine for movement with respect thereto, wherein said frame further comprises first and second longitudinally spaced transverse supports, each of which is configured to be supported on the railway, and first and second clamp assemblies, each of which is configured to releasably clamp a respective one of said supports to at least one rail of the railway; wherein two of said guide rails are provided and are transversely spaced from one another so as to laterally flank a longitudinal centerline of the railway section during a grinding operation, each of said guide rails having opposed ends supported on said transverse supports, and wherein said grinding machine includes a chuck that supports a rotatable grinding tool and a carriage that supports said chuck on said guide rails and that is movable longitudinally along said guide rails, wherein said chuck is movable on said carriage linearly transversely of said guide rails in order to permit the grinding tool to grind a tapered surface of the railway section.

9. The system as recited in claim 8, wherein said chuck is movable vertically relative to said guide rails in order to permit adjustment of a grinding depth of said grinding tool.

10. The system as recited in claim 9, wherein said carriage comprises a platform that is movable linearly transversely relative to said guide rails, and wherein said chuck is mounted on said platform so as to be movable vertically relative to said platform.

11. The system as recited in claim 8, wherein said chuck is configured to permit replacement of said grinding tool with another grinding tool of a different configuration.

12. The system as recited in claim 11, wherein said grinding tool is a cup grinder configured to grind an upper surface of the railway section, and wherein said chuck is configured to permit replacement of said cup grinder with one of a flange grinder configured to grind a side surface of the railway section and a cup stone configured to grind a tapered surface of the rail section.

13. The system as recited in claim 8, wherein said frame further comprises clamp assemblies that are adjustable relative to associated transverse supports so as permit alteration of an angle between the reference path and a longitudinal centerline of the railway section.

14. The system as recited in claim 8, wherein said grinding machine is configured to grind a rail frog in situ.

15. The system as recited in claim 8, wherein said frame is at least 6' long.

16. The rail grinding system as recited in claim 8, wherein said chuck is movable vertically, transversely, longitudinally, and rotatably relative to said guide rail.

17. A rail grinding system comprising:

(A) a frame that is capable of being secured to a railway in situ at locations that are spaced from opposed ends of a deformed section of the railway to be ground, said frame defining a reference path; and (B) a grinding machine that is mounted on said frame so as to be movable therealong to grind the railway section along a path defined at least in part by said reference path, said frame being sufficiently long to prevent the reference path from being influenced by the railway section geometry, wherein said frame comprises at least one longitudinal guide rail that supports said grinding machine for movement with respect thereto, wherein said frame further comprises first and second longitudinally spaced transverse supports, each of which is configured to be supported on the railway, and first and second clamp assemblies, each of which is configured to releasably clamp a respective one of said supports to at least one rail of the railway; wherein two of said guide rails are provided and are transversely spaced from one another so as to laterally flank a longitudinal centerline of the railway section during a grinding operation, each of said guide rails having opposed ends supported on said transverse supports, wherein said grinding machine includes a chuck, a rotatable grinding tool that supports the chuck, and a carriage that supports said chuck on said guide rails and that is movable longitudinally along said guide rails, wherein said chuck is movable on said carriage linearly transversely of said guide rails in order to permit the grinding tool to grind a tapered surface of the railway section, and wherein said chuck is rotatable relative to said carriage about an axis that is generally parallel to said guide rails.

18. The system as recited in claim 17, wherein said chuck is configured to permit replacement of said grinding tool with another grinding tool of a different configuration.

19. The system as recited in claim 18, wherein said grinding tool is a cup grinder configured to grind an upper surface of the railway section, and wherein said chuck is configured to permit replacement of said cup grinder with one of a flange grinder configured to grind a side surface of the railway section and a cup stone configured to grind a tapered surface of the rail section.

20. A rail frog grinding system comprising:

(A) a frame that is capable of being secured to a railway in situ at locations that are spaced from opposed ends of a frog of the railway, said frame comprising (1) first and second longitudinally spaced transverse beams, each of which is configured to be supported on at least two spaced rails of the railway at a location spaced from an associated end of the frog;

(2) first and second clamp assemblies, each of which is configured to releasably clamp a respective one of said beams to at least two spaced rails of the railway; and (3) first and second longitudinal guide rails that extend between and are supported on said beams, said guide rails being at least 8' long and defining a reference path that is configured to be unaffected by frog geometry, and (B) a grinding machine including (1) a carriage including wheels that are rollably supported on said guide rails and a platform that is supported on said wheels so as to be movable transversely of said wheels, (2) a chuck that is mounted on said platform so as to be 1) movable vertically relative to said platform and 2) rotatable relative to said platform about an axis that is parallel to said reference path, and (3) first and second grinding wheels interchangeably mountable on said chuck, said first grinding wheel being configured to grind an upper surface of the frog and said second grinding wheel being configured to grind a side surface of the frog.

21. A railway grinding system comprising:

(A) a frame that is releaseably secured over a railway in situ at locations that flank opposed ends of a railway section to be ground, the railway section including at least two spaced rails, said frame defining a reference path for grinding the railway and including (1) first and second longitudinally spaced transverse supports, each of which is supported on the at least two spaced rails; and (3) first and second longitudinal guide rails, each of which extends between and is supported on said transverse supports at a location that is transversely outboard of the rails of the railway section to be ground, a reference path being determined by the position of said guide rail, wherein said guide rail is sufficiently long to prevent the reference path from being influenced by the geometry of the railway section; and (B) a grinding machine including a chuck and a rotatable grinding tool that is supported on said chuck, said chuck being supported on said guide rails so as to be linearly movable vertically, longitudinally, and laterally of the railway section, thereby permitting said grinding tool to move relative to said guide rail to grind the railway section.

* * * * *